US006690800B2

(12) United States Patent
Resnick

(10) Patent No.: US 6,690,800 B2
(45) Date of Patent: Feb. 10, 2004

(54) METHOD AND APPARATUS FOR COMMUNICATION OPERATOR PRIVACY

(76) Inventor: Andrew M. Resnick, 4815 Grantham Ave., Bethesda, MD (US) 20815-5537

( * ) Notice: Subject to any disclaimer, the term of this patent is extended or adjusted under 35 U.S.C. 154(b) by 0 days.

(21) Appl. No.: 09/683,741

(22) Filed: Feb. 8, 2002

(65) Prior Publication Data

US 2003/0152240 A1 Aug. 14, 2003

(51) Int. Cl.[7] ..... H04R 3/02
(52) U.S. Cl. ..... 381/73.1
(58) Field of Search ..... 381/71.1–71.14

(56) References Cited

U.S. PATENT DOCUMENTS 5,937,070 A * 8/1999 Todter ..... 381/71.6

FOREIGN PATENT DOCUMENTS

EP 0756407 * 1/1997

* cited by examiner

*Primary Examiner*—Minsun Oh Harvey

(57) ABSTRACT

Disclosed is a device for use with communications equipment to provide privacy for the operator and reduce acoustic noise from the operator's voice in the area. The device uses active acoustic cancellation to silence the voice of the operator once past, and captured by the microphone. Embodiments include the all types of microphones for any type of telephone, transmitting radio, intercom or other communication devices where a operator speaks out loud to communicate with another location.

20 Claims, 9 Drawing Sheets

Microphone Signal
Silencing Signal
Noise Cancel
Comm. Device
Silencing Signal
Equalize
106
117
118
119
To Comm. Device Transmission Circuits Microphone Signal
Silencing Signal
Feedback Reduction
Comm. Device
Silencing Signal
Equalize
116
117
118
119
To Comm. Device Transmission Circuits

METHOD AND APPARATUS FOR COMMUNICATION OPERATOR PRIVACY

BACKGROUND OF INVENTION

This invention relates to the active acoustic silencing of conversations being conducted by communications equipment such as telephones, transmitting radios and other electronic apparatus.

Remote communication between people operating telephones, radios or other devices is common place to the point where conversations often take place while either or both operators' speech is unintentionally overheard by other people. Examples include cellular telephones used in public, telephones used in multi-occupant rooms such as office cubicle spaces, open sided public pay phones, 2-way radio transmissions, and anywhere the operator of a communications device can be overheard. The result is that the operator can not have a private conversation. In addition to the operator's loss of privacy, people overhearing intelligible conversation are significantly distracted resulting in loss of concentration and efficiency.

Prior art is from two areas: communications operators' privacy and active acoustic silencing.

Privacy for the operators speaking on communications devices has previously only used passive devices such as U.S. Pat. No. 5,182,883 to Amberson a telephone enclosure or the "Hush-a-Phone" type handsets that enclosed the operator's mouth such as U.S. Pat. No. 271,903 to Nichols. These devices use passive acoustical dampening to quiet the sound or sealed off the operator's voice to prevent it from propagating. The sealing devices either required putting a sealed container around the operator (e.g. telephone booths with closing doors) or for the device to seal to the operator, i.e. around the operator's mouth, with a host of maintenance and sanitary issues that many patents tried to addressed. Both types are rarely used any longer.

There is a notable lack of devices applying active acoustic silencing or active acoustic canceling (synonymous terms) to communications operator privacy. Active acoustic silencing was first patented in the Lueg U.S. Pat. No. 2,043,416. Active acoustic silencing has seen application in reducing noise in confined spaces like ducts and exhausts, as in U.S. Pat. No. 4,815,139 to Eriksson, et al. and in reducing background noise for operators listening to acoustic signals on headsets, as in U.S. Pat. No. 5,675,658 to Brittian. Methods and devices for applying it to specific noise sources have been patented several times such as U.S. Pat. No. 5,872,853 to Marquiss for reduce noise from highways and U.S. Pat. No. 5,889,869 to Botros et al. for reduce noise from adjacent workspaces.

Efforts up to now to provide such conversational privacy involve passive mechanical arrangements which have several problems including: inconvenient to use, unsanitary, high maintenance, and size.

The need for privacy for telecommunication operators has increased with cellular telephones and office cubicle telephones providing no privacy for the operator and causing a significant distraction for other people in the area.

SUMMARY OF INVENTION

This invention utilizes active acoustic silencing to provide speech privacy for the operator of communications equipment such as all types of telephones, transmitting radios, intercoms, and the like. The invention also reduces distracting noise from the operator's speech for the people in the adjacent area. The invention attaches to or integrates with the communications equipment with no impact on the equipment's convenience or sanitation, and little impact on maintenance or size greatly improving on prior efforts to obtain such privacy.

The invention applies active acoustic silencing to the problem of speech privacy for the operator of communications equipment. The active acoustic silencing of the operator's voice while using communications equipment results in both privacy of the operator's communications and reduction in distraction for other people in the vicinity.

The invention may be embodied as an attachment to existing communication equipment, with or without electrical connections, or embodied as an integral part of a communications device.

The preferred embodiments of the invention add one or more loudspeakers behind the microphone of a communication device's handset or headset, and some additional circuitry inside the communication device. Other embodiments of the invention vary in their degree of integration with the communications device. A second embodiment of the invention replaces the communications device's handset or headset apparatus and connects electrically to the communications device. Another embodiment physically attaches to the communications device with no electrical connections and uses a separate microphone, placed adjacent to the communications device microphone.

The generalize function of the invention is illustrated in FIG. 1 and summarized as follows. A unidirectional microphone (1) captures the operator's speech (4) just in front of the operator's mouth (10). The electrical signal from the microphone goes to a electrical or electronic circuit (6) which processes the signal to: amplified it, split off the signal to be sent by communication equipment, modify the signal to produce the silencing signal, amplify the signal to the needed volume for the cancellation, and send the signal to the loudspeaker (2) placed in front of the operator's mouth and further away than the microphone (1).

In FIG. 1, the acoustic silencing takes place in the air between the element of the microphone (1) and the loudspeaker (2). The operator's speech modulates the sound pressure level verses position (7) commonly called sound waves. The silencing loudspeaker (2) produces the mirror sound pressure level (9). Where the two sound waves meet (8) the both sounds are reduced by active acoustic cancellation.

Applications of the invention include embodiments for all types of communications devices including: cellar telephones, cordless telephones, wired telephones, intercoms or 2-way radios. The invention is applicable any where a communications device operator's speech may be overheard to preserve privacy or to avoid disturbing others.

DETAILED DESCRIPTION

Figure 1:
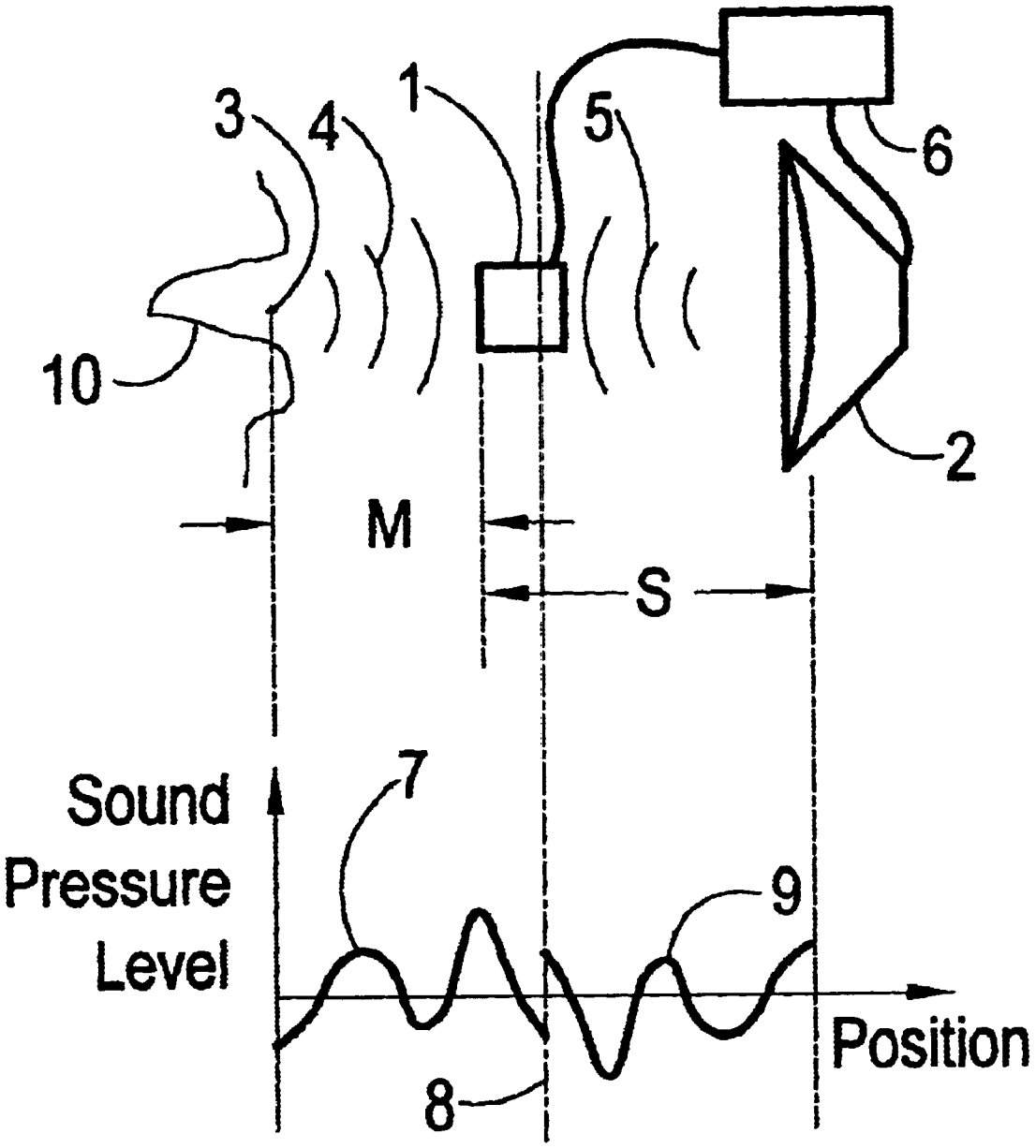
FIG. 1 illustrates the principles of the invention.

The generalize function of the invention is illustrated in FIG. 1 and summarized as follows. A microphone (1) or acoustic sensor captures the operator's speech (4) just in front of the operator's mouth (10). The electrical signal from the microphone goes to a electrical or electronic circuit (6) which processes the signal to: amplified it, split off the signal to be sent by communication equipment, modify the signal by mirroring, inverting, or phase shifting to produce the silencing signal, amplify the signal to the needed volume for the cancellation, and send the signal to the loudspeaker (2) or transducer placed in front of the operator's mouth and further away than the microphone (1).

The microphone (1) may comprise any device or combination of devices for turning acoustical signals into electrical signals over the frequency range of human speech, preferentially unidirectional. The loudspeaker (2) may comprise any device or combination of devices for turning electrical signals into acoustic signals over the frequency range of human speech, preferentially focusing the produced acoustic signals toward a point to create a complement to the dispersion pattern of the human mouth The loudspeaker requires a means of reducing audible emissions from the back of the speaker, such as a sealed back.

In FIG. 1, the acoustic silencing takes place in the air between the element of the microphone (1) and the loudspeaker (2). The operator's speech modulates the sound pressure level verses position (7) commonly called sound waves. The silencing loudspeaker (2) produces the mirror sound pressure level (9). Where the two sound waves meet (8) the sound pressure levels cancel, measurably reducing the volume and intelligibility of the speech.

The invention requires the distance between the loudspeaker face and the microphone face (labeled S in FIG. 1) to be greater than the signal processing time divided by the velocity of sound in air, i.e.:

$$S>T/V \qquad \text{(Equation 1)}$$

S=distance between the invention's microphone face and loudspeaker face.

T=Time between the microphone receiving and the loudspeaker broadcasting the signal.

V=Velocity of sound in air.

For best sound cancellation performance the distance between the operator's mouth reference point (3) and the microphone (1) face, labeled M in FIG. 1, is minimized.

Figure 2:
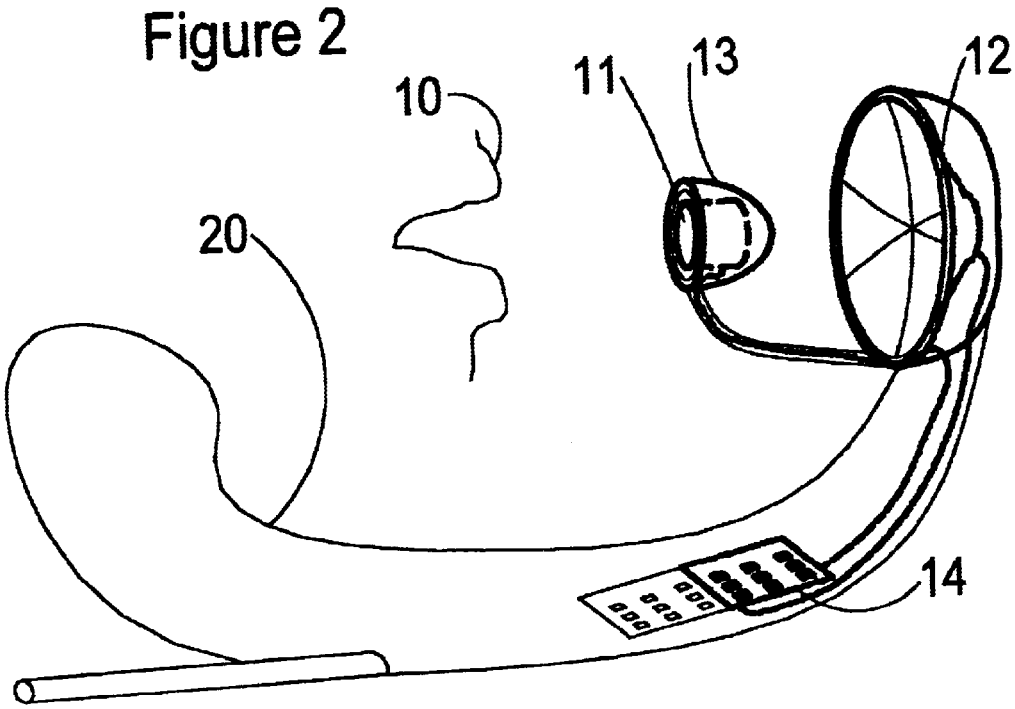
FIG. 2 illustrates a preferred embodiment of the invention.

A preferred embodiment is with the invention integrated into the communications device as illustrated in FIG. 2. The integration in this embodiment uses one microphone (11) and shared signal processing circuitry (14) and shared power supply (not shown) for the communications device and for the invention. The preferred embodiment's housing places both the microphone (11) and the silencing loudspeaker (12) in the handset (20) (or headset) both positioned to aim at, the operator's mouth (10). The microphone and silencing loudspeaker are each connected by wires to the processing circuit (14) which may be located anywhere in the communications device such as in the handset or in the separate housing of a wired communications device such as a land line telephone (not shown). The design must satisfy the relationship of Equation (1) above.

The handset (20) (or headset) includes a microphone (11) that converts the acoustic signal to an electrical signal for both the communications device and the acoustic silencing. The microphone (11) is shielded from the acoustic silencing sound by a acoustic damping material barrier (13) which supports the microphone in the hand or head set and isolates it from vibrations. The microphone (11) is preferred to be unidirectional and may be of a variety of designs to be compatible with the electrical, space, and frequency requirements.

The silencing loudspeaker (12) is behind the microphone (11) mounted to satisfy equation 1. The loudspeaker (12) may be made of one or more electrical to acoustic transducers. The loudspeaker's (12) design preferably focus the sound waves toward the operator's mouth (10) to create a complement to the dispersion pattern of the human mouth. The loudspeaker (12) has a means of preventing audible acoustic emissions from the backside of the loudspeaker, e.g. a sealed back. The loudspeaker (12) may be a variety of designs to produce a sound pressure level field that cancels the operator's voice and meet the electrical, space and frequency requirements.

Figure 3:
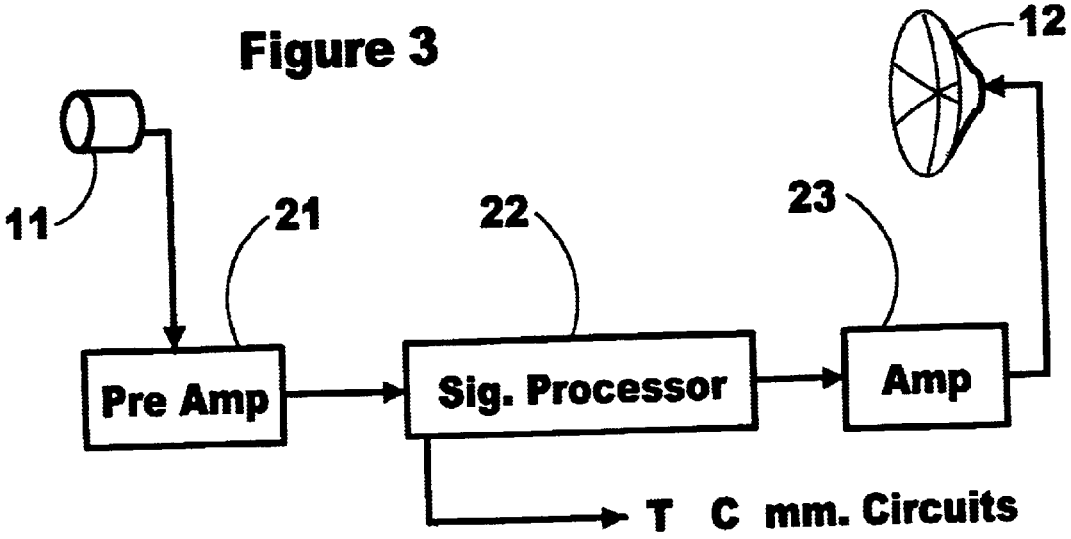
FIG. 3 illustrates a block diagram and signal path of the invention for the preferred embodiment.

A block diagram of the signal path for a preferred embodiment is illustrated in FIG. 3. The acoustic signal from the operator's voice converted to an electrical signal by the microphone (11). The microphone sends the signal on to the pre-amplifier (21) to strengthen the signal. The pre-amplifier sends the signal on to the signal processor (22). The signal processor circuit sends the transmission signal to the communication device's circuitry then modifies the signal to create the silencing signal and then sends the silencing signal to the amplifier (23). The silencing signal goes through the amplifier (23) and to the loudspeaker (12) where it is transformed into the acoustic silencing signal.

Figure 4:
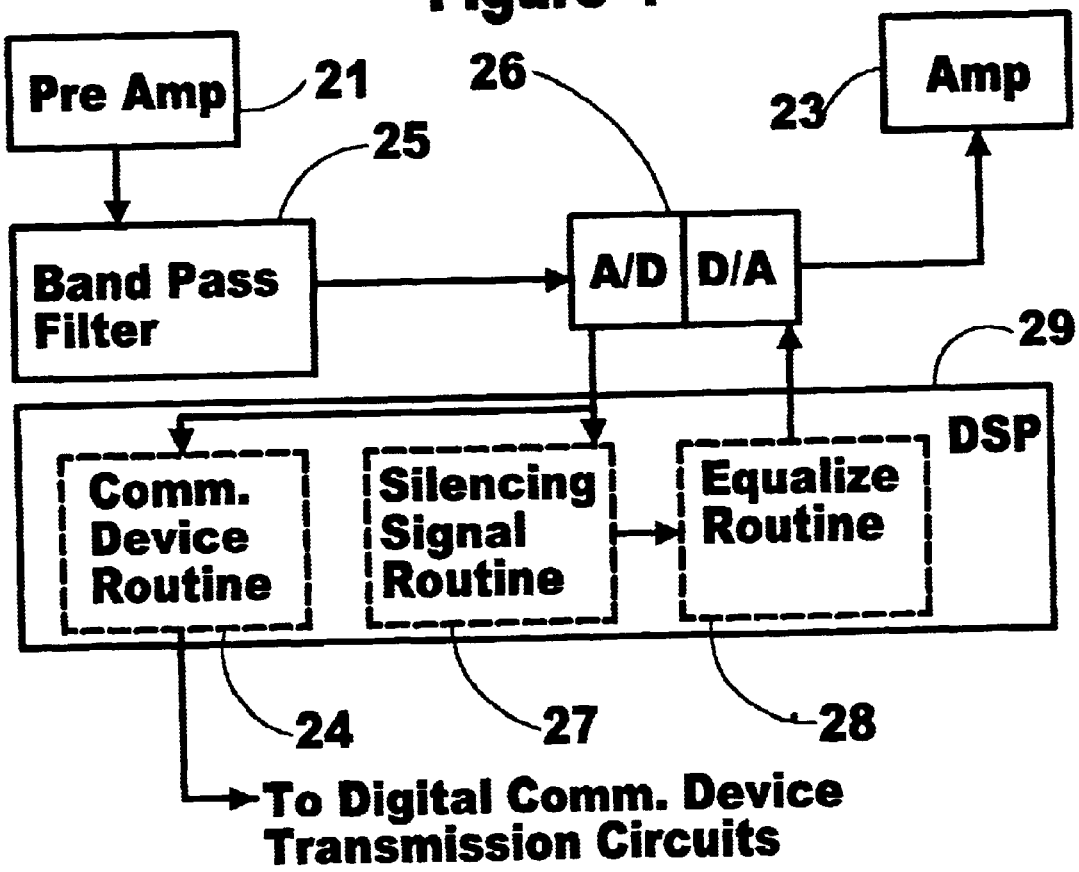
FIG. 4 illustrates the signal processing in a digital embodiment of the invention with a digital communications device.

In FIG. 4 the steps to be performed by the signal processing circuitry are shown using a digital signal processor (DSP) (29) integrated to a digital communications device. The steps are: analogue filtering to pass only the frequency range of speech from 100 Hz to 8 kHz (25); convert the analogue signal to digital (A/D) (26); in the DSP (29) the signal is copied to the communications device software routine (24) and the silencing software routine (27); software on the DSP performs the operations to modify the signal into a silencing signal by inverting, mirroring, or shifting phase of the signal (27); software on the DSP equalizes the signal for pre-calibrated microphone and loudspeaker distortions and to match the sound pressure level of the operator's voice in the incoming signal (28); convert the signal from digital to analogue (D/A)(26); and output the silencing signal to the amplifier (23).

Figure 5:
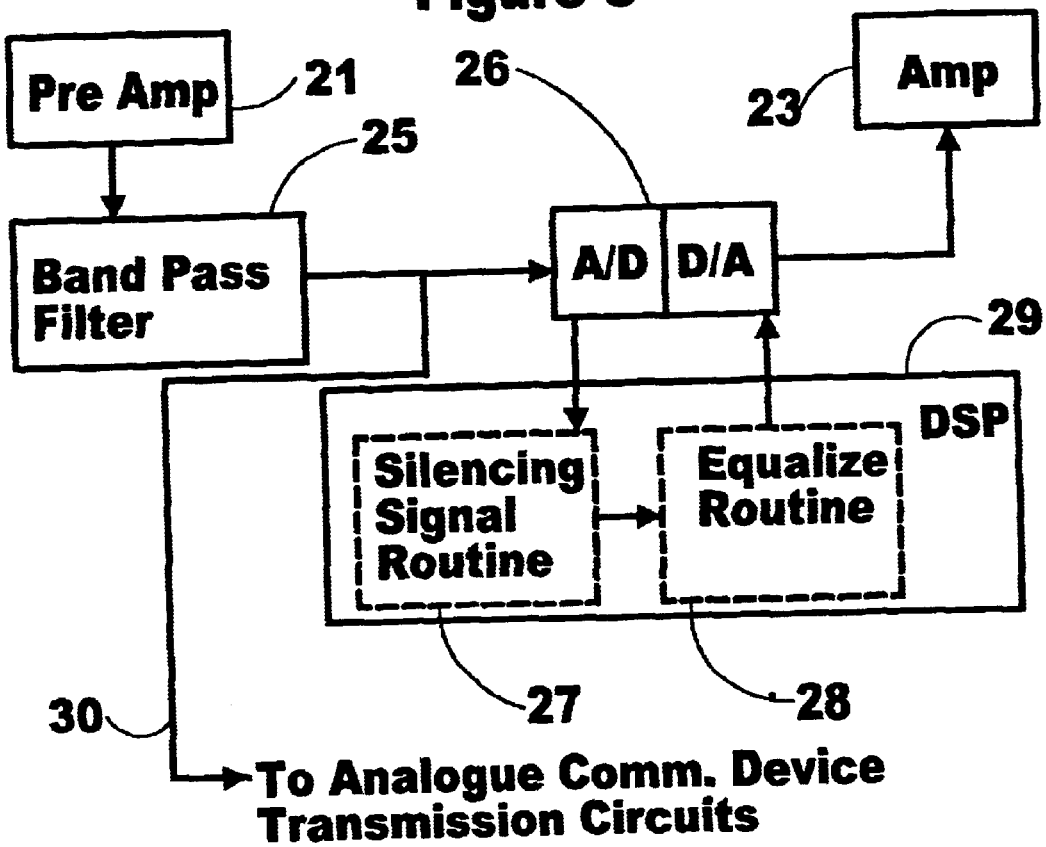
FIG. 5 illustrates the signal processing in a digital embodiment of the invention with a analogue communications device.

In FIG. 5 the steps to be performed by the signal processing circuitry are shown using a digital signal processor (DSP) (29) integrated to a analogue communications device. The steps are the same as that described above for integration to a digital communications device shown in FIG. 4. The connection to the communication device moves to the analogue signal split to the communications device circuitry (30) from the Band Pass Filter (25).

Figure 6:
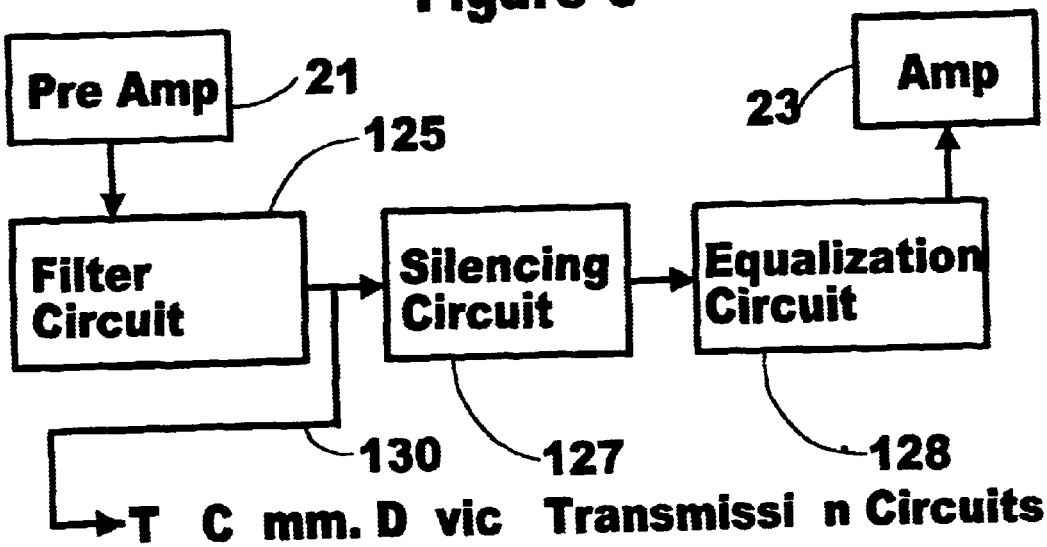
FIG. 6 illustrates the steps in a analogue signal processing embodiment of the invention.

In FIG. 6 the steps to be performed are shown using analogue signal processing circuitry, which is integrated to either a digital or analogue communications device by the same connection (130). The steps are: receive the microphone signal from the pre-amplifier (21); analogue filtering to pass only the frequency range of speech from 100 Hz to 8 kHz (125); the signal is split to the communications device (130) and to the silencing circuitry (127); the silencing circuitry (127) mirrors, inverts, or phase shifts the signal to create the silencing signal; circuitry equalizes the signal for pre-calibrated microphone and loudspeaker distortions and to match the sound pressure level of the operator's voice in the incoming signal (128); and output the silencing signal to the amplifier (23).

Figure 7:
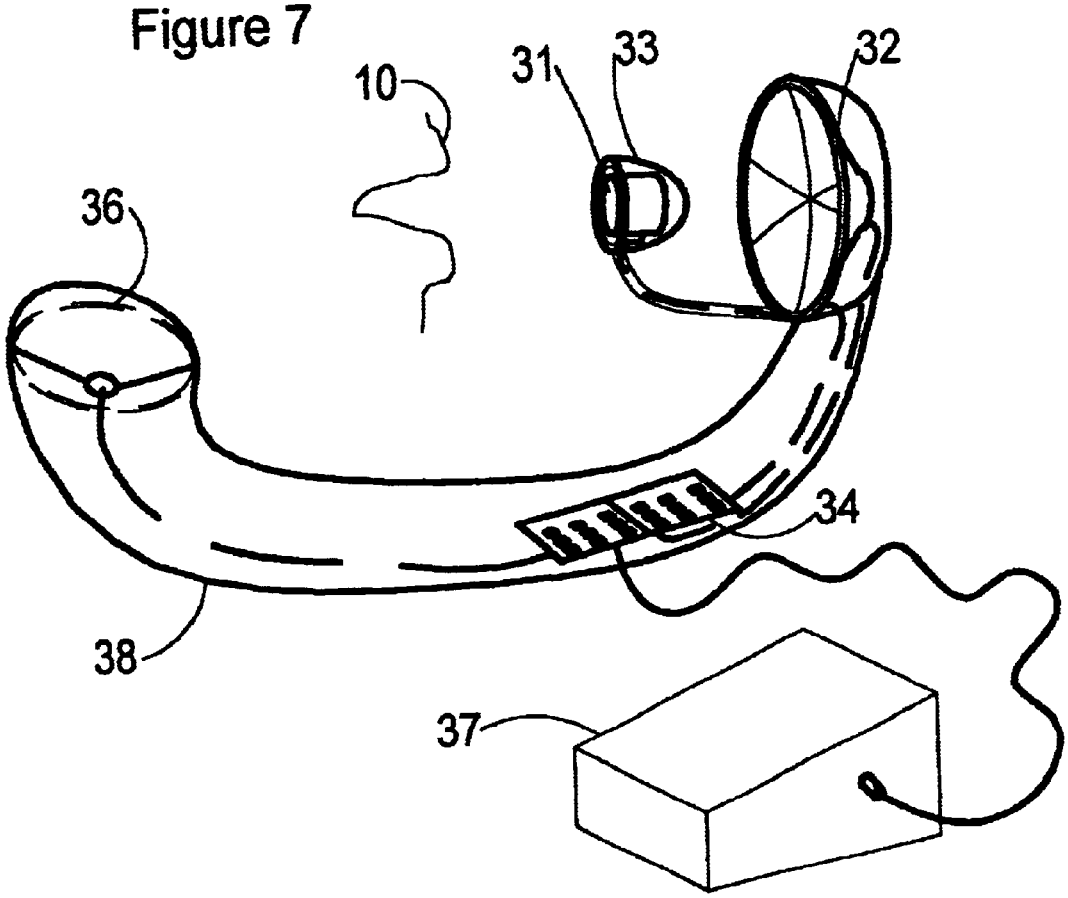
FIG. 7 illustrates a second embodiment of the invention.

In a second embodiment, illustrated in FIG. 7, the invention takes the form of a handset (38) (or headset) plugging into the communications device (37) as a replacement or add-on such as is common for communications accessories for example "hands free headsets". The communications device may be any type including: cellular telephone, cordless telephone, wired telephone, intercom, announcing system or transmitting or 2-way radio. This embodiment uses one shared microphone (31), partially shared signal processing circuitry (34), and either shared or separate power supply depending on the communications device's design. This second embodiment's housing places both the microphone (31) and the silencing loudspeaker (32) in the handset (38) (or headset) both positioned to aim at the operator's mouth (10). The microphone and silencing loudspeaker are each connected by wires to the processing circuit (34) which is located in the handset (38) (or headset) or in the connector housing at the communications device (37). The handset's communications loudspeaker (36) is mounted in the handset and connected to the communications device (37) by wires. The design must satisfy the requirements of equation 1, above. The second embodiment may be powered from batteries, from the wall electrical outlet, or from the communications device.

In this second embodiment the handset (38) (or headset or microphone) includes a microphone (31) that converts the acoustic signal to an electrical signal for both the communications device and the acoustic silencing. The microphone (31) is shielded from the acoustic silencing sound by an acoustic damping material barrier (33) which supports the microphone in the handset (38) (or headset) and isolates it from vibrations. The microphone (31) is preferred to be unidirectional and may be variety of designs to be compatible with the electrical, space, and frequency requirements.

In the second embodiment the silencing loudspeaker (32) is behind the microphone (31) mounted in the handset (38) (or headset) to satisfy equation 1. The loudspeaker's (32) may be comprised of one or more electrical to acoustic transducers. The loudspeaker's (32) design preferably focuses the sound waves toward the operator's mouth (10) to create a complement to the dispersion pattern from the human mouth. The loudspeaker has a means of preventing audible acoustic emissions from the backside of the loudspeaker, e.g. a sealed back. The loudspeaker (32) may be a variety of designs to produce a sound pressure level field that cancels the operator's voice and meet the electrical, space and frequency requirements.

Figure 8:
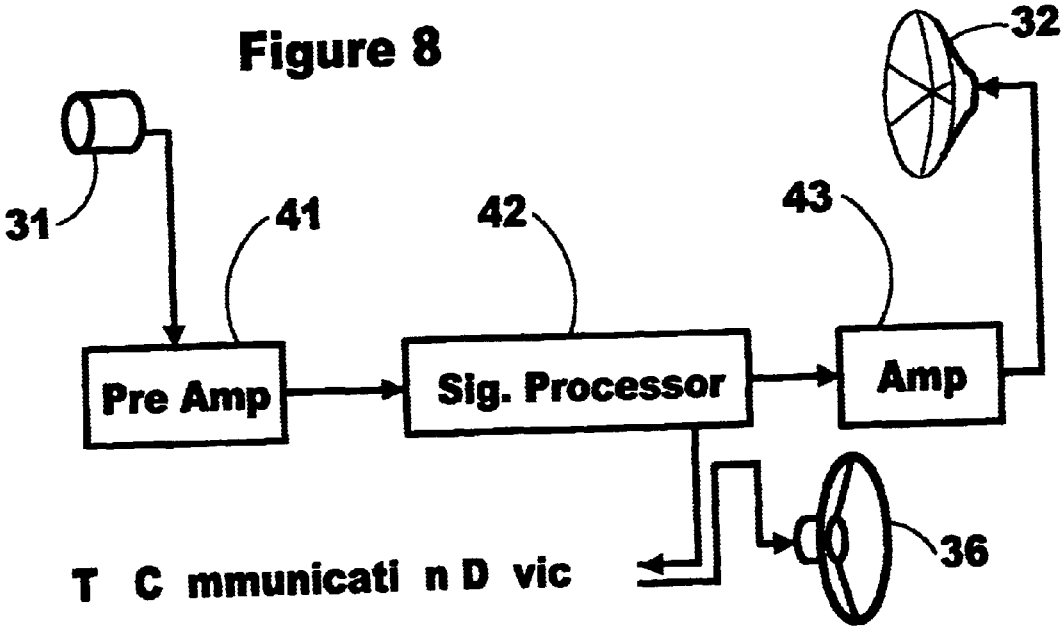
FIG. 8 illustrates a block diagram and signal path of the invention for the second embodiment.

A block diagram of the signal path for the second embodiment is illustrated in FIG. 8. The acoustic signal from the operator's voice converted to an electrical signal by the microphone (31). The microphone sends the signal on to the pre-amplifier (41) to strengthen the signal. The pre-amplifier sends the signal on to the signal processor (42). The signal processor circuit then modifies the signal and sends the transmission signal to the communication device and the silencing signal to the amplifier (43). The silencing signal goes through the amplifier (43) and to the loudspeaker (32) where it is transformed into the acoustic silencing signal. The handset also receives the incoming signal from the communications device and sends it directly to the communications loudspeaker (36).

The signal processor for the second embodiment may be either digital or analogue design and follows the steps for the preferred embodiment as illustrated in FIGS. 4, 5 and 6 and described above.

Figure 9:
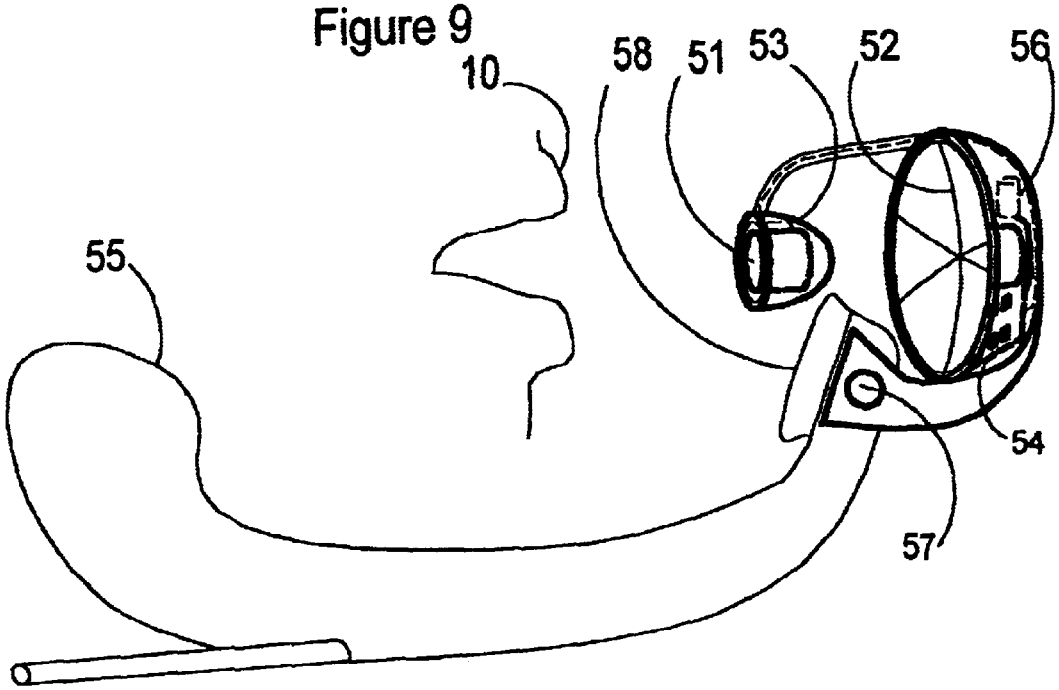
FIG. 9 illustrates a third embodiment of the invention.

A third embodiment of the invention is as a separate, self contained package that attaches to the microphone housing of a remote communications device illustrated in FIG. 9. In this embodiment there is no electrical connection between the communications device and the invention. The invention attaches to the communications device's handset (55) (or headset or microphone). The communications device may be any type including: cellular telephone handset, cordless telephone, wired telephone, intercom or transmitting radio.

The third embodiment uses a separate microphone (51), signal processing circuitry (54) and power supply (56) for the invention. The attachment (57) by has a means of angular adjustment so that the invention's microphone and silencing loudspeaker may both be positioned by the operator to aimed at, the operator's mouth (10). The invention's microphone (51) and silencing loudspeaker (52) are each connected by wires to the processing circuit (54) which may be located with the loudspeaker (52) or in a separate housing at the body of the communications device connected by wires to the handset attachment (not shown). The design must satisfy the requirements of Equation 1 above for both the invention's microphone and the communications microphone. The device may be powered from batteries (56) or from a wall electrical outlet (not shown).

The third embodiment includes a microphone (51) that converts the acoustic signal to an electrical signal for the acoustic silencing. The microphone is preferred to be unidirectional and mounted with an acoustic damping material barrier (53) to isolate it from vibrations. The microphone (51) may be variety of designs to be compatible with the electrical, space, and frequency requirements.

The silencing loudspeaker (52) is behind the microphone (51) and the communications microphone (58) to satisfy equation 1 with both microphones. The loudspeaker's (52) design preferably focuses the sound waves toward the operator's mouth (10) to create a complement to the dispersion pattern from the human mouth. The loudspeaker has means of preventing audible acoustic emissions from the backside of the loudspeaker, e.g. a sealed back. The loudspeaker (52) may be a variety of designs to produce a sound pressure level field that cancels the operator's voice and meet the electrical, space and frequency requirements.

Figure 10:
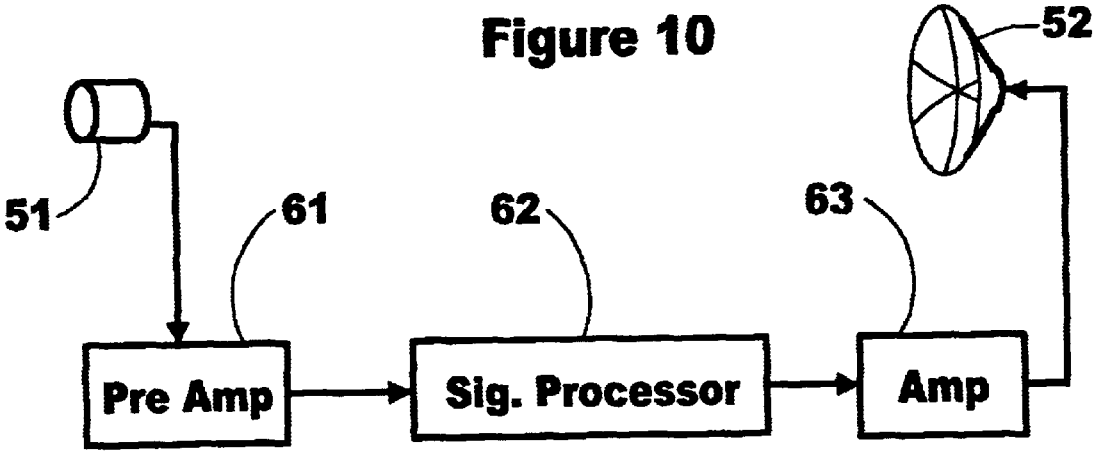
FIG. 10 illustrates a block diagram and signal path of the invention for the third embodiment.

A block diagram of the signal path for the third embodiment is illustrated in FIG. 10. The acoustic signal from the operator's voice converted to an electrical signal by the microphone (51). The microphone sends the signal on to the pre-amplifier (61) to strengthen the signal. The pre-amplifier sends the signal on to the signal processor (62). The signal processor circuit then modifies the signal and sends the silencing signal to the amplifier (63). The silencing signal goes through the amplifier (63) and to the loudspeaker (52) where it is transformed into the acoustic silencing signal and travels as a sound wave toward the operator's mouth. The communications device's signal operates independently of the invention.

The signal processor for the third embodiment may be either digital or analogue design and follows the steps for the preferred embodiment illustrated in FIGS. 4, 5 and 6 and described above except with the deletion of the connection to the communications device (24) in FIG. 4, (30) in FIG. 5 and (130) in FIG. 6.

Many variations on these embodiments are feasible. Each of the described embodiments may be varied in housing location, housing style, circuitry, number of elements such as multiple loudspeakers or microphones, use of digital, analogue or a mixture of circuitry, source of power or inclusion of the enhancements. All the embodiments of the invention can be used with any kind of communications device such as all types of telephones, transmitting or 2-way radios, intercoms, and announcement devices. The invention can work with all types of microphone configurations including handsets, headsets, hand microphones, stand microphones or microphones integrated into a console or device.

Figure 11:
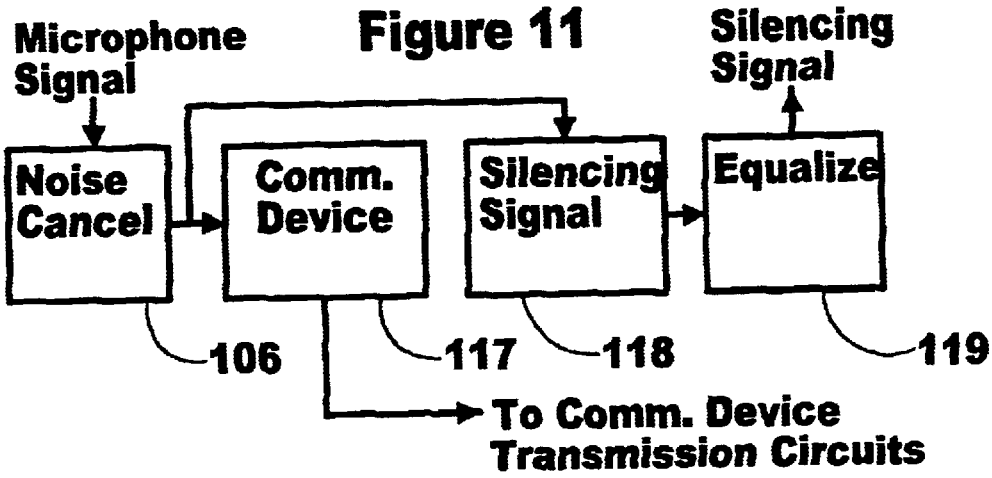
FIG. 11 illustrates the enhancement of using a noise cancellation process.

An enhancement improves the invention by reducing background noise, picked up by the microphone, in the silencing signal. An embodiment of this enhancement in the signal processing, described above, is illustrated in FIG. 11. The embodiment applies prior art noise reduction to filter background noise from the microphone signals (e.g. in analogue U.S. Pat. No. 4,723,294 to Taguchi, and in digital U.S. Pat. No. 5,680,393 to Bourmeyster). As shown in FIG. 11 the microphone signal has the background noise removed by noise cancel (106); the signal is copied the communications device processing (117) and the silencing processing (118); the signal is modified into a silencing signal by inverting, mirroring, or shifting phase of the signal (118); the signal is equalized for pre-calibrated microphone and loudspeaker distortions and to match the sound pressure level of the operator's voice in the incoming signal (119). This enhancement may be applies to all embodiments.

Figure 12:
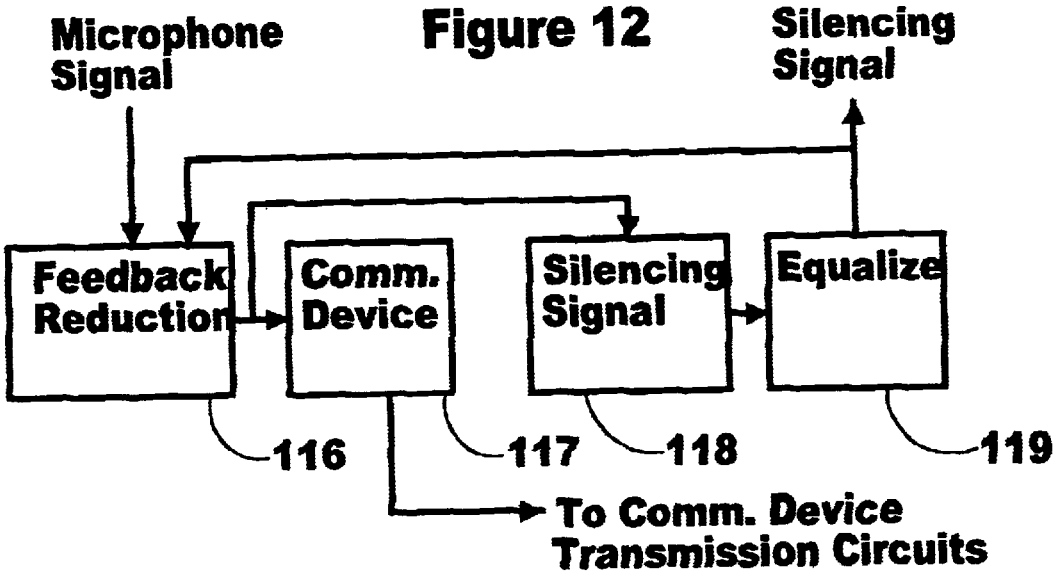
FIG. 12 illustrates the enhancement of using a feedback reduction process.

Another enhancement of the invention will control acoustic feedback by removing the silencing signal from the incoming signal. Embodiments for this enhancement use prior art for feedback suppression (e.g. in analogue U.S. Pat. No. 4,164,715 to Thurmond, and in digital U.S. Pat. No. 5,091,952 to Williamson) in the invention's signal processing circuitry, a block diagram of which is shown in FIG. 12. As shown in FIG. 12 the microphone signal has the feedback removed by the feedback reduction (116); the signal is copied the communications device processing (117) and the Silencing processing (118); the signal is modified into a silencing signal by inverting, mirroring, or shifting phase of the signal (118); the signal is equalized for pre-calibrated microphone and loudspeaker distortions and to match the sound pressure level of the operator's voice in the incoming signal (119). The silencing signal is sent to both the amplifier and the feedback reduction (116) This enhancement may be applies to all embodiments.

Figure 13:
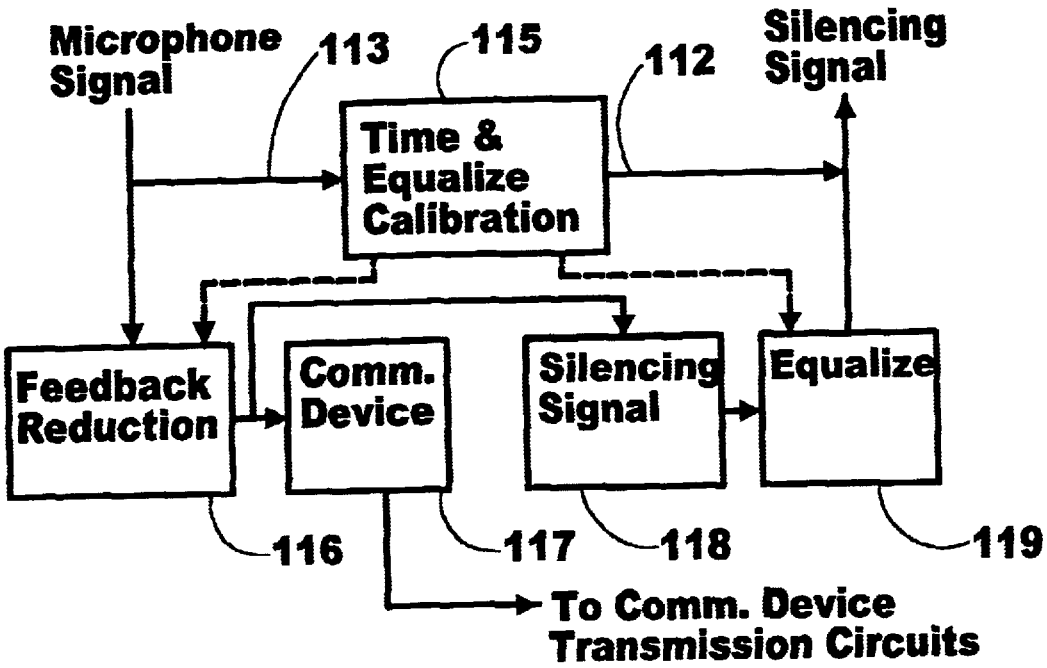
FIG. 13 illustrates the enhancement of using a calibration process.

In another enhancement the signal processing circuitry periodically calibrates the distance and signal transformation of the microphone and loudspeaker. The recalibration reduces dependency on the physical condition and spacing between the microphone and loudspeaker and improves silencing performance when the physical characteristics of the microphone and loudspeaker change. The enhancement may be embodied in the signal processing circuit as a self calibration using prior art for adaptive filters. As illustrated in FIG. 13 the signal processing circuitry includes a time and equalization calibration part (115) that sends a known signal (112), covering the frequency range of speech, out through the amplifier and loudspeaker, then receives the signal in from the microphone (113), and computes the delay and transform coefficients from the two signals. The coefficients are then used in the signal processor's for equalization (119) and feedback reduction (116) if included. This enhancement may be applies to all embodiments.

Figure 14:
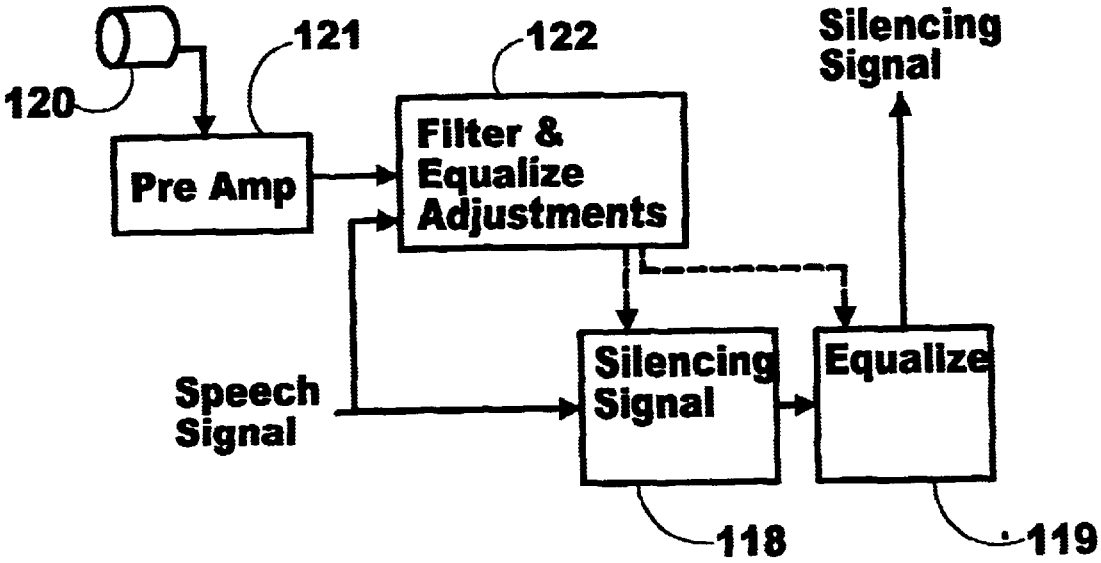
FIG. 14 illustrates the enhancement of using adaptive processing.

Another enhancement improves the acoustic silencing of the device by adjusting the filtering and equalization of the silencing signal in the processing circuit. Illustrated in FIG. 14 this embodiment uses additional microphone(s) (120) to measure the residual speech sound also termed in prior art the silencing error. The error signal from the microphone (120) is amplified in a pre-amp (121) and then send to the processing circuitry. The error signal is then used for adaptive control of the coefficients for the filtering and equalization (122) of the silencing signal to minimize silencing error using prior art such as U.S. Pat. No. 4,473,906 to Warmaka. The coefficients are then applied in the silencing signal (118) and equalization (119) processing. The enhancement can be embodied in either analogue or digital circuitry. This enhancement may be applies to all embodiments.

Figure 15:
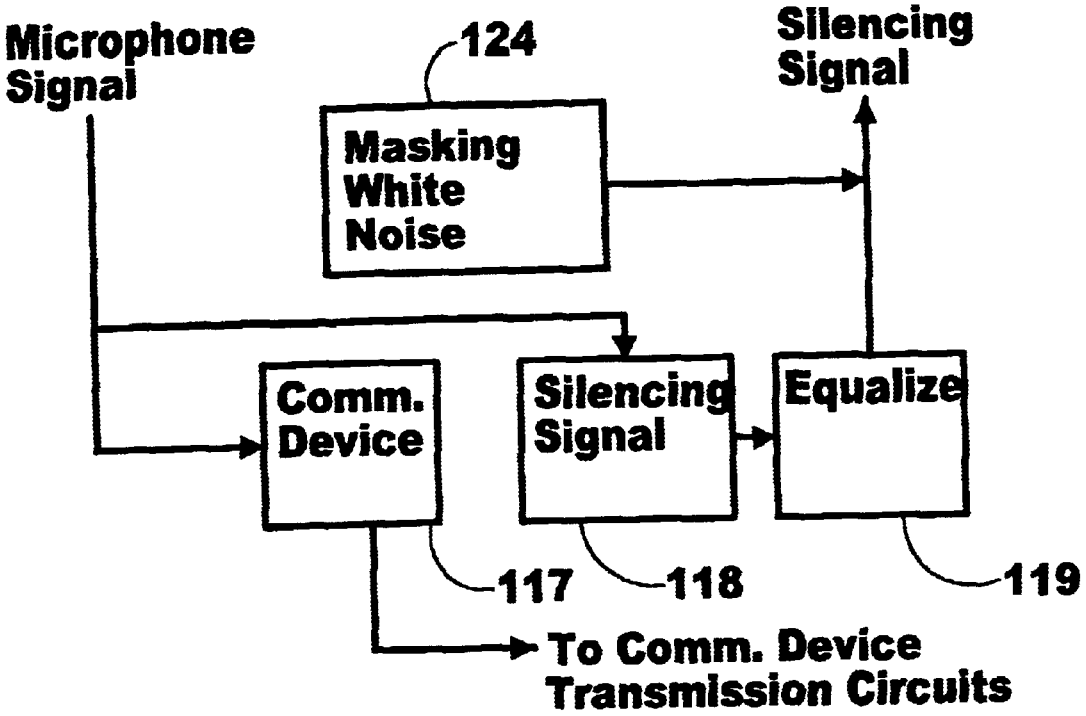
FIG. 15 illustrates the enhancement of using a masking noise.

Another enhancement is to provide further privacy by adding a masking noise to the silencing signal. The preferred masking noise is a Gaussian signal covering the frequency range of speech, with a signal level equal to the estimated level of the residual speech signal. As show in FIG. 15, the masking noise is generated in the signal processing circuitry (124) using prior art and added to the silencing signal after the equalization (119).

Figure 16:
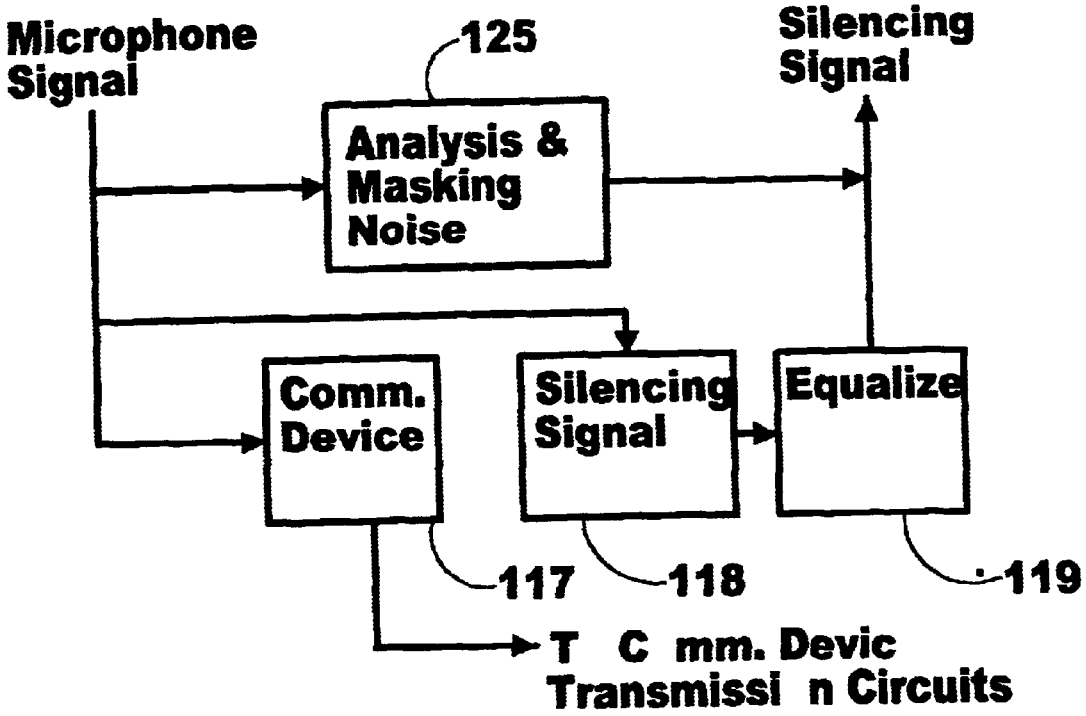
FIG. 16 illustrates the enhancement of using a frequency complement masking noise.

A further enchantment to the masking is to use the signal processing circuit to analyze the speech signal to create a combined residual signal that is white noise (as shown in FIG. 16). This is done by an analysis and masking noise circuit or routine (125) periodically computing the frequency spectrum of the speech signal using a fast Fourier transform. Then computing the residual signal spectrum by reducing the speech signal spectrum by a measured, preset amount. Then the masking signal spectrum is found by subtracting the residual signal spectrum from a Gaussian spectrum of a preset level. The masking signal is then computed from the masking signal spectrum using an inverse fast Fourier transform. The resulting masking signal is the frequency complement to the residual speech signal. The masking signal is added to the silencing signal after equalization (119) and sent to the amplifier. The acoustic sum of the masking signal and the residual speech signal is a Gaussian signal. This enhancement may be applied to all embodiments.

While certain preferred embodiments of this invention have been described, it is understood that many variations are possible without departing from the principles of this invention as defined in the claims which follow.

What is claimed is:

1. An active acoustic silencing apparatus that works as or with the microphone of telephonic or transmitting communications equipment to maintain the privacy of a transmitting operator's speech and reduce noise in the area from said operator's speech comprising:

a) a device having a microphone to receive operator originated acoustic signals composed of speech originating from an operator of said apparatus and producing a microphone signal, a signal processing circuit for amplifying and processing the microphone signal, creating electrical silencing signals, and amplifying said electrical silencing signals, and a loudspeaker or transducer for receiving the amplified electrical silencing signals from said signal processing circuit;

b) said loudspeaker or transducer converting said electrical silencing signals to acoustic silencing signals; and c) said loudspeaker or transducer being positioned in front of and facing the transmitting operator's month position and said microphone located between the transmitting operator's mouth position and said loudspeaker or transducer so as to result in substantial cancellation of operator originated speech beyond a front face of said microphone.

2. The device according to claim 1, having a communication circuit and wherein said signal processing circuit also copies the microphone signal to said communication circuit.

3. The device according to claim 1, wherein said signal processing circuit adjusts the volume of said acoustic silencing signals to match the strength of an operator's speech.

4. The device according to claim 1, wherein said signal processing circuit performs noise reduction on the signal from the microphone to reduce background noise.

5. The device according to claim 1, having means to reduce feedback of the silencing signals into the microphone by means of filtering the acoustic silencing signals from the microphone signal.

6. The apparatus according to claim 1, having means to reduce feedback of the silencing signals into the microphone comprised of an acoustic barrier made of acoustically damping material positioned between the microphone and the loudspeaker or transducer to reduce the sound from the loudspeaker or transducer entering the microphone.

7. The device according to claim 1, having means to improve silencing by equalization or filtering of the silencing signals to correct for signal distortion of the microphone and loudspeaker by means of the signal processing circuit applying a frequency dependent, amplitude correction to the silencing signals.

8. The device according to claim 7 having means to further improve silencing by calibrating the said equalization or filtering of the silencing signals by means of said signal processing circuit periodically following a preset algorithm to send a known signal through the amplifier, loudspeaker or transducer, microphone, and a preamplifier and adjusting the equalization or filtering coefficients based on the distortion of the silencing signals.

9. The apparatus according to claim 7, having means to further improve silencing comprising a second microphone measuring the silencing error and an algorithm in the signal processing circuit to adjust the equalization or filtering coefficients to minimize the error.

10. The method of maintaining privacy of speech directed into a microphone by canceling said speech beyond said microphone comprising the steps of:

a) positioning a microphone in front of the mouth of an operator to receive speech originating from said mouth of said operator, said microphone producing an electrical signal from said speech;

b) placing a loudspeaker in front of the mouth of said operator with said loudspeaker behind said microphone;

c) amplifying and processing said electrical signal to create an electrical silencing signal; and d) sending said electrical silencing signal to said loudspeaker for generating from said electrical silencing signal an acoustic silencing signal to provide speech privacy for said operator, the distance between a front thee of said loudspeaker and a front face of said microphone being such as to result in substantial cancellation of operator originated speech beyond the front face of said microphone.

11. The method of claim 10 in which said electrical signal produced by said microphone is also used in a communications device.

12. The method of claim 11 in which said communications device is a telecommunications handset or headset and a second loudspeaker is mounted in said handset or headset for reception by said operator.

13. The method of claim 11 in which said communication device is a telecommunications handset or headset, said microphone and loudspeaker being formed as a separate, self contained package, said package being attached to said handset or headset.

14. The method of claim 11, in which said microphone is shielded from the acoustic silencing signal by an acoustic damping material barrier which supports the microphone in said communications device and isolates said microphone from vibrations.

15. The method of claim 14 in which said loudspeaker focuses said acoustic silencing signal toward the mouth of said operator.

16. A communications set incorporating acoustic silencing far maintaining privacy of speech so that other persons in the vicinity will hear less of any conversation by an operator of said set comprising:

a) a microphone mounted in said set for producing an electrical signal from speech directed by said operator at said microphone;

b) processing circuitry in said set for amplifying and processing the electrical signal to create an electrical silencing signal; and c) a loudspeaker mounted in said set in front of and facing the mouth of said operator and behind said microphone that converts said electrical silencing signal to an acoustic silencing signal, the distance between a front face of said microphone and a front face of said loudspeaker being sufficient to result in substantial cancellation of said speech beyond the front face of said microphone.

17. The communications set of claim 16 having means isolating said microphone against vibrations and providing an acoustic silencing barrier for said microphone in said set.

18. The communications set of claim 16 in which said microphone and loudspeaker are formed into a separate, self contained package, said package being attached to said communications set.

19. An active acoustic silencing apparatus that works as or with the microphone of telephonic or transmitting communications equipment to maintain the privacy of a transmitting operator's speech and reduce noise in the area from the operator's speech comprising:

a) a device having a microphone to receive operator originated acoustic signals composed of speech originating from an operator of said apparatus and producing a microphone signal, a signal processing circuit for amplifying and processing the microphone signal, creating electrical silencing signals, and amplifying said electrical silencing signals, and a loudspeaker or transducer for receiving the amplified electrical silencing signals from said signal processing circuit;

b) said loudspeaker or transducer converting said electrical silencing signals to acoustic silencing signals; and c) said loudspeaker or transducer being physically positioned with respect to said microphone to satisfy the relationship:

$$S>T/V$$

where: S=distance between front faces of said microphone and loudspeaker or transducer facing the operator, T=time between the microphone receiving a signal and the loudspeaker or transducer broadcasting its signal, and V=velocity of sound in air, so as to result in substantial cancellation of said operator originated acoustic signals beyond a front face of said microphone.

20. A communications set incorporating acoustic silencing for maintaining privacy of speech so that other persons in the vicinity will hear less of any conversation by a user of said set comprising:

a) a microphone mounted in said set for producing an electrical signal from speech directed by said user at said microphone;

b) processing circuitry in said set for amplifying and processing the electrical signal to create an electrical silencing signal; and c) a loudspeaker mounted in said set behind said microphone facing in the same direction as said microphone and further away from said user than said microphone, the distance between a front face of said microphone and a front face of said loudspeaker being defined by the following relationship:

$$S>T/V$$

where S=distance between the invention's microphone face and loudspeaker face,

T=time between the microphone receiving a signal and the loudspeaker broadcasting its signal, and V=velocity of sound in air.

* * * * *